US011388802B2

(12) United States Patent
Su et al.

(10) Patent No.: US 11,388,802 B2
(45) Date of Patent: Jul. 12, 2022

(54) LIGHTING APPARATUS

(71) Applicant: XIAMEN LEEDARSON LIGHTING CO., LTD, Fujian (CN)

(72) Inventors: Wenkun Su, Fujian (CN); Shihai Huang, Fujian (CN); Hongkui Jiang, Fujian (CN); Zhiqing Chen, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/394,949

(22) Filed: Aug. 5, 2021

(65) Prior Publication Data

US 2022/0046777 A1 Feb. 10, 2022

(30) Foreign Application Priority Data

Aug. 7, 2020 (CN) ..... 202021636030.9

(51) Int. Cl.

| | |
|---|---|
| ***H05B 45/10*** | (2020.01) |
| ***H05B 45/30*** | (2020.01) |
| ***H05B 45/50*** | (2022.01) |
| ***H05B 45/14*** | (2020.01) |

(52) U.S. Cl.

CPC ..... *H05B 45/50* (2020.01); *H05B 45/14* (2020.01); *H05B 45/30* (2020.01)

(58) Field of Classification Search

CPC ..... H05B 45/10; H05B 45/14; H05B 45/28; H05B 45/30; H05B 47/10; H05B 47/105

See application file for complete search history.

(56) References Cited

U.S. PATENT DOCUMENTS

| | | | | |
|---|---|---|---|---|
| 9,307,619 | B2 * | 4/2016 | Campbell | H05B 47/185 |
| 2010/0090604 | A1 * | 4/2010 | Maruyama | H05B 45/31 315/119 |
| 2014/0265893 | A1 * | 9/2014 | Melanson | H05B 39/044 315/192 |
| 2016/0100466 | A1 * | 4/2016 | Kim | H05B 47/17 315/250 |
| 2016/0330808 | A1 * | 11/2016 | Brandt | H05B 45/10 |
| 2017/0094738 | A1 * | 3/2017 | Garner | H05B 45/10 |

* cited by examiner

*Primary Examiner* — Thai Pham

(74) *Attorney, Agent, or Firm* — Chun-Ming Shih; Lanway IPR Services

(57) ABSTRACT

A lighting apparatus includes a light source, a bridge circuit, a voltage node, a filter circuit, a dimmer check circuit and a control circuit. The light source includes a LED module. The bridge circuit generates a DC power at a voltage node by converting an AC power. The filter circuit is connected to the voltage node for converting the DC power to a driving current to the LED module. The dimmer check circuit is coupled to the voltage node for generating a dimmer check signal by detecting whether a wall dimmer is electrically coupled to the lighting apparatus. The control circuit adjusts a setting of the filter circuit according to the dimmer check signal.

20 Claims, 8 Drawing Sheets

LIGHTING APPARATUS

FIELD

The present invention is related to a lighting apparatus, and more particularly related to a lighting apparatus with a wall dimmer.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

TRIAC (Triode for Alternating Current) is largely used in wall dimmers. TRIAC circuits are widely used, and very common in AC power control applications. These circuits have the ability to switch high voltages, as well as very high levels of current in the two parts of an AC waveform. They are semiconductor devices, similar to a diode.

TRIAC is often used as a means of light dimming in domestic lighting applications, and can even serve as a power control in motors.

TRIAC's ability to switch high voltages makes it an ideal choice for use in diverse electrical control applications. This means it can work to suit everyday lighting-control needs. TRIAC circuits are used for more than just domestic lighting though, they are also utilised when controlling fans and small motors, and also in other AC switching and control applications.

However, LED devices are usually not compatible with TRIAC circuits. It is therefore important to design a smart circuit to automatically detect existence of TRIAC circuits and respond to different cases to keep safety of light devices.

SUMMARY

In some embodiments, a lighting apparatus includes a light source, a bridge circuit, a voltage node, a filter circuit, a dimmer check circuit and a control circuit.

The light source includes a LED module.

The bridge circuit generates a DC power at a voltage node by converting an AC power.

The filter circuit is connected to the voltage node for converting the DC power to a driving current to the LED module.

The dimmer check circuit is coupled to the voltage node for generating a dimmer check signal by detecting whether a wall dimmer is electrically coupled to the lighting apparatus.

The control circuit adjusts a setting of the filter circuit according to the dimmer check signal.

In some embodiments, the wall dimmer is a TRIAC dimmer.

In some embodiments, the DC power is a sine wave DC power.

In some embodiments, the filter circuit includes a constant current circuit for generating the driving current.

In some embodiments, the filter circuit includes a PI filter.

In some embodiments, the dimmer check circuit detects a voltage drop at the voltage node.

When the voltage drop over a first threshold is detected, the dimmer check signal indicates the wall dimmer is existed.

In some embodiments, the dimmer check circuit includes multiple resistors and a capacitor.

The multiple resistors are used for dividing a Vbus voltage at the voltage node, and the capacitor is used for filter the sine wave DC power.

In some embodiments, the dimmer check circuit detects a voltage cut angle at the voltage node.

When the voltage cut angle is detected, the dimmer check signal indicates the wall dimmer is existed.

In some embodiments, the dimmer check circuit has a integral circuit for accumlating a voltage variation to detect the voltage cut angle.

In some embodiments, the dimmer check circuit detects a phase cut angle at the voltage node.

When the phase cut angle is detected, the dimmer check signal indicates the wall dimmer is existed.

In some embodiments, the dimmer check circuit includes a comparator for retrieving a Vcc voltage of the filter circuit.

The comparator compares the Vcc voltage with a Vbus voltage at the voltage node to detect whether the wall dimmer is existed.

In some embodiments, the control circuit increases a support current when the wall dimmer is detected.

In some embodiments, the control circuit transmits a command to indicate an external the existance of the wall dimmer.

In some embodiments, the control circuit transmit the dimmer check signal to another lighting apparatus via a wireless channel.

Said another lighting apparatus is also electrically connected to AC power.

In some embodiments, a TRIAC setting is detected by the dimmer check circuit.

The control circuit converts the TRIAC setting to a PWM signal supplied to the filter circuit to change the driving current to the LED module.

In some embodiments, the lighting apparatus may also include a manual switch.

When the manual switch is turned on, the dimmer check circuit is disabled.

In some embodiments, the control circuit detects a TRIAC vlaue variation of the wall dimmer within a time period to switch among multiple working modes of the filter circuit.

In some embodiments, the LED module has multiple types of LED units with different light parameters.

In a first working mode, a TRIAC setting of the wall dimmer is used for adjusting a first type of LED units.

In some embodiments, the LED module has multiple types of LED units with different light parameters.

In a second working mode, a TRIAC setting of the wall dimmer is used for adjusting a first type of LED units.

In some embodiments, the LED module has multiple types of LED units with different light parameters.

In a third working mode, a TRIAC setting is used for adjusting a color temperature of the LED module.

DETAILED DESCRIPTION

Figure 8:
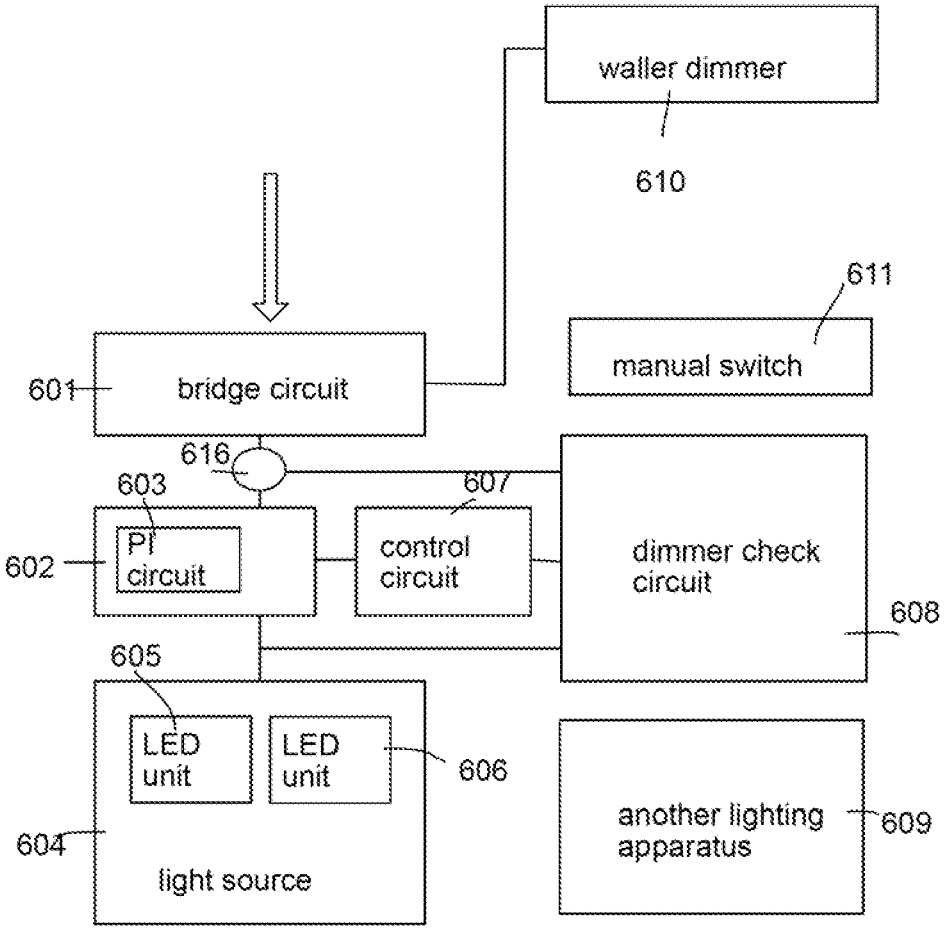
FIG. 8 illustrates an embodiment of a lighting apparatus.

In FIG. 8, a lighting apparatus includes a light source 604, a bridge circuit 601, a filter circuit 602, a dimmer check circuit 608 and a control circuit 607.

The light source 604 includes a LED module that may include multiple types of LED units 605, 606.

The bridge circuit 601 generates a DC power at a voltage node 616 by converting an AC power.

The filter circuit 602 is connected to the voltage node 616 for converting the DC power to a driving current to the LED module.

The dimmer check circuit 608 is coupled to the voltage node 616 for generating a dimmer check signal by detecting whether a wall dimmer 610 is electrically coupled to the lighting apparatus.

The control circuit 607 adjusts a setting of the filter circuit according to the dimmer check signal. The control circuit 607 may increase a current when the wall dimmer 610 is detected for compensating a current loss due to the wall dimmer 610. For example, a common TRIAC dimmer may cause certain safety issue for dropping the voltage current in an unexpected case.

In some embodiments, the wall dimmer is a TRIAC dimmer.

In some embodiments, the DC power is a sine wave DC power. For example, a bridge circuit converts negative parts of an AC sine wave to positive parts to form a DC power of a sine power signal which negative parts are converted to positive counterparts.

In some embodiments, the filter circuit 604 includes a constant current circuit for generating the driving current. The sine wave power signal still has larger variation and thus a constant current source may be used for generating a final driving current supplied to the light source 604. In some embodiments, PMW (Pulse Width Modulation) signals are used for adjusting a DC output by selecting a certain portion of time to turn off the DC output.

In some embodiments, the filter circuit 602 includes a PI filter 603.

In some embodiments, the dimmer check circuit detects a voltage drop at the voltage node. TRIAC dimmer usually causes a voltage drop. When the voltage drop is detected by the dimmer check circuit 608, the wall dimmer 610 is determined existed.

When the voltage drop over a first threshold is detected, the dimmer check signal indicates the wall dimmer is existed.

In some embodiments, the dimmer check circuit includes multiple resistors and a capacitor. A detailed The multiple resistors are used for dividing a Vbus voltage at the voltage node, and the capacitor is used for filter the sine wave DC power.

In some embodiments, the dimmer check circuit detects a voltage cut angle at the voltage node.

When the voltage cut angle is detected, the dimmer check signal indicates the wall dimmer is existed.

In some embodiments, the dimmer check circuit has a integral circuit for accumlating a voltage variation to detect the voltage cut angle.

In some embodiments, the dimmer check circuit detects a phase cut angle at the voltage node.

When the phase cut angle is detected, the dimmer check signal indicates the wall dimmer is existed.

In some embodiments, the dimmer check circuit includes a comparator for retrieving a Vcc voltage of the filter circuit.

The comparator compares the Vcc voltage with a Vbus voltage at the voltage node to detect whether the wall dimmer is existed.

In some embodiments, the control circuit increases a support current when the wall dimmer is detected.

Sometimes, TRIAC dimmer causes current drop that is not expected by common LED light drivers. Therefore, a compensation current is increased to keep the current output stable and prevents blinking of the light source.

In some embodiments, the control circuit 607 transmits a command to indicate an existance of the wall dimmer 610.

In some embodiments, the control circuit transmit the dimmer check signal to another lighting apparatus 609 via a wireless channel. For example, multiple light devices are grouped and thus the resource is shared for multiple light devices.

Said another lighting apparatus is also electrically connected to AC power.

In some embodiments, a TRIAC setting is detected by the dimmer check circuit.

The control circuit converts the TRIAC setting to a PWM signal supplied to the filter circuit to change the driving current to the LED module.

In some embodiments, the lighting apparatus may also include a manual switch 611.

When the manual switch 611 is turned on, the dimmer check circuit 608 is disabled.

In some embodiments, the control circuit 607 detects a TRIAC vlaue variation of the wall dimmer 610 within a time period to switch among multiple working modes of the filter circuit. For example, if the TRIAC dimmer is detected to turn on and to turn off within 2 seconds, the control circuit 607 activates a mode switch operation to switch among multiple operation modes.

In some embodiments, the LED module has multiple types of LED units with different light parameters.

In a first working mode, a TRIAC setting of the wall dimmer is used for adjusting a first type of LED units.

In some embodiments, the LED module has multiple types of LED units with different light parameters.

In a second working mode, a TRIAC setting of the wall dimmer is used for adjusting a first type of LED units.

In some embodiments, the LED module has multiple types of LED units with different light parameters.

In a third working mode, a TRIAC setting is used for adjusting a color temperature of the LED module.

Please refer to FIG. 1 to FIG. 7, which show some variations of embodiments.

Figure 1:
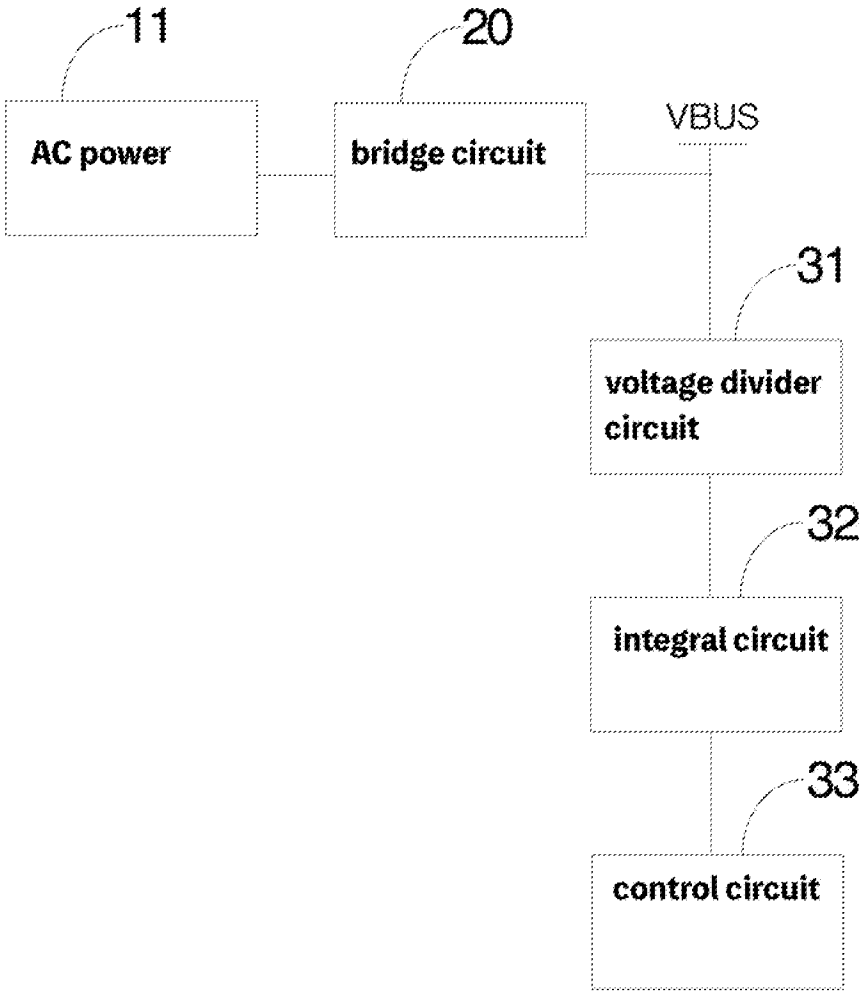
FIG. 1 illustrates a circuit diagram of a driver cricuit.

In FIG. 1, an AC power 11 is supplied to a bridge circuit 20 to generate a DC current at a power node, VBUS. A voltage divider circuit 31 is used for dividing a voltage of VBUS to be detected. An integral circuit 32 may be used as the function mentioned above. A control circuit 33 is used for providing compensation to power supply to light sources.

Figure 2:
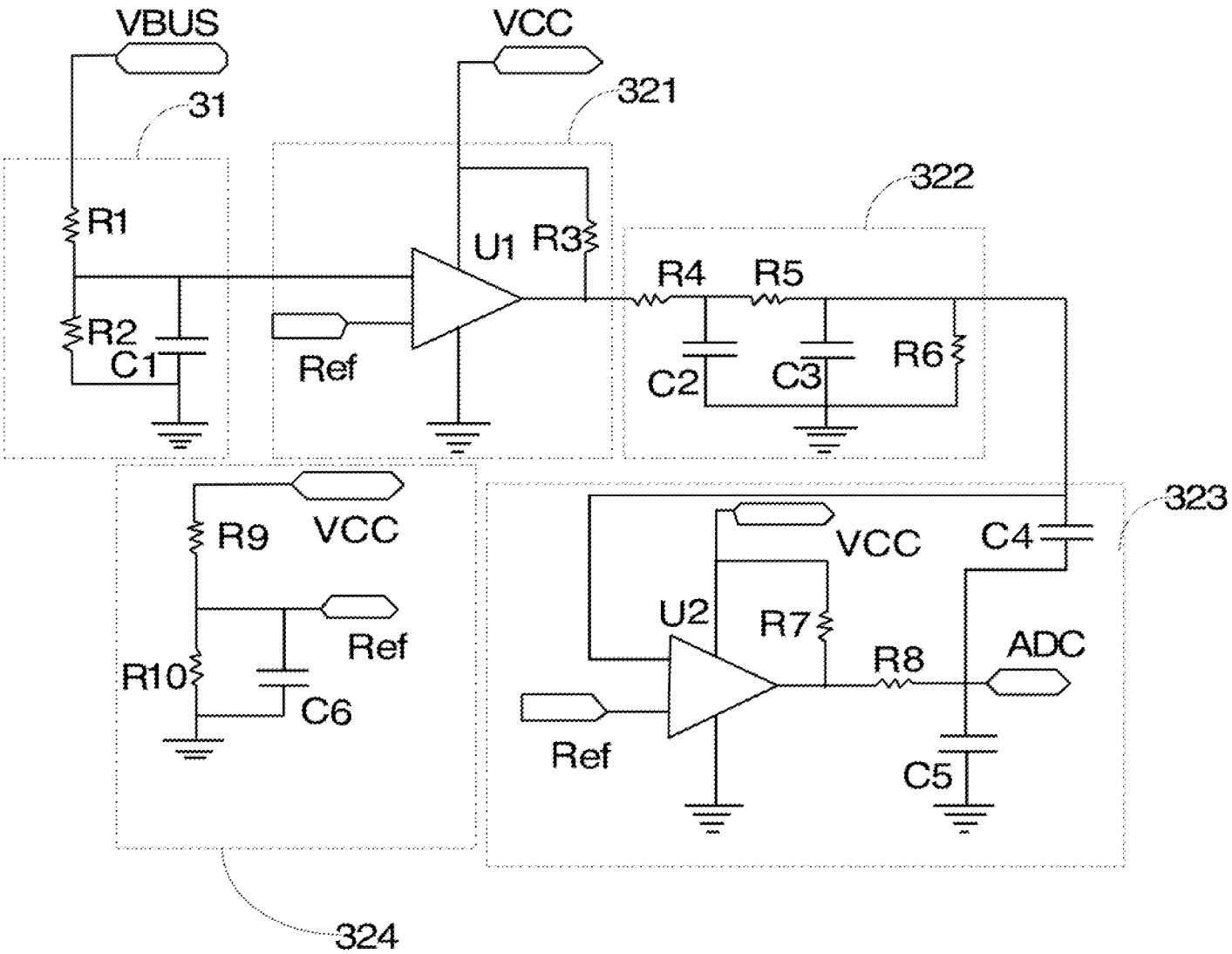
FIG. 2 illustrates a detailed circuit example.

FIG. 2 illustrates a detailed circuit example. In FIG. 2, the lighting apparatus includes a voltage divider circuit 31, a first comparator 321, a reference voltage unit 324, an integral unit 322 and a second comparator unit 323.

Figure 3:
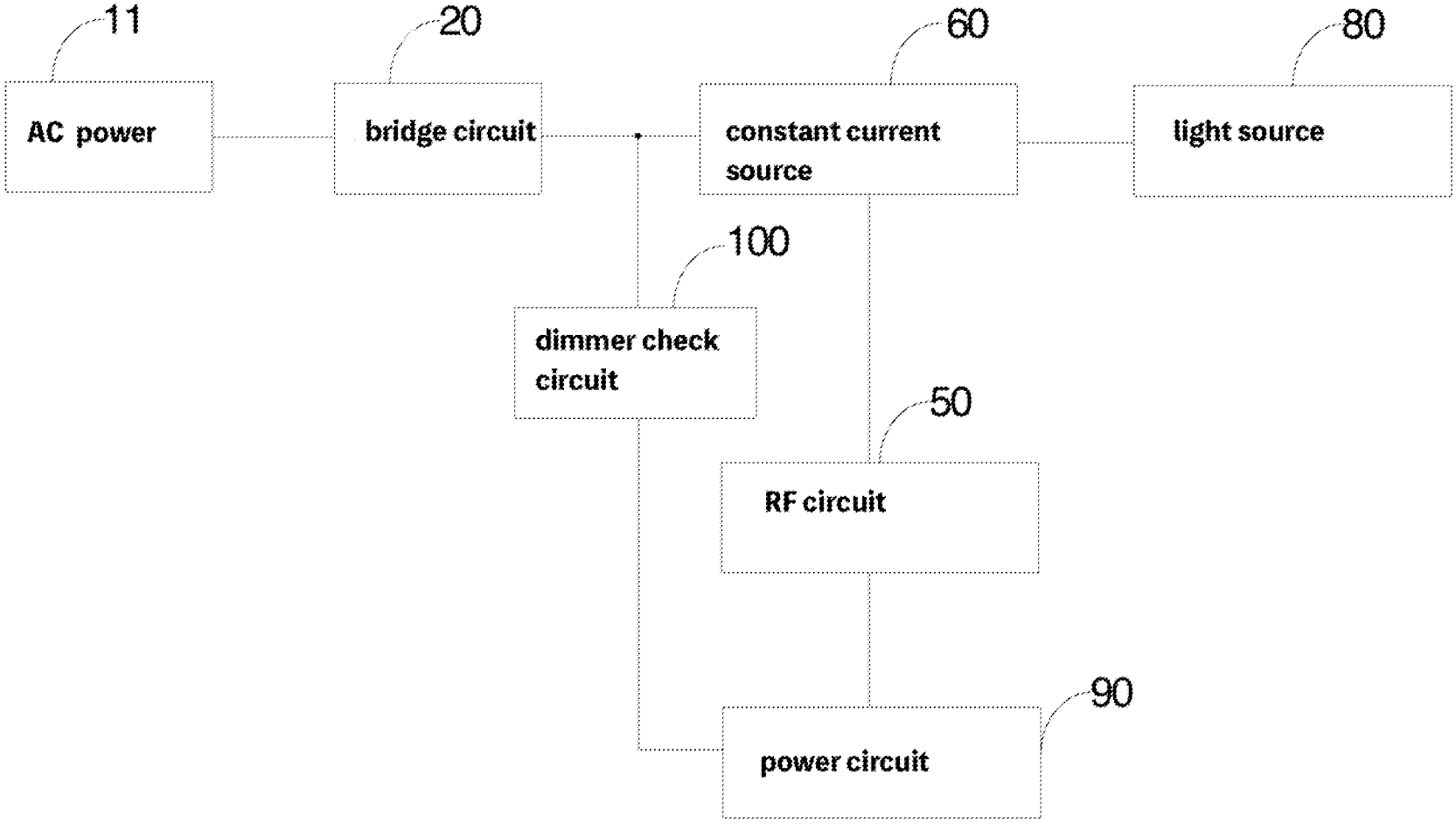
FIG. 3 illustrates another circuit diagram of a driver circuit in another embodiment.

FIG. 3 shows another embodiment.

In FIG. 3, the AC power 11 is supplied to a bridge circuit 20. A dimmer check circuit 110 is used for checking whether a wall dimmer is attached. A RF circuit 50 is used for sending and receiving a wireless signal to communicate with other devices like another lighting apparatus or a remote control.

A power circuit 90 is provided for generating constant currents to RF circuit 50 or other circuits. The light source 80 receives power from the constant current source 60.

Figure 4:
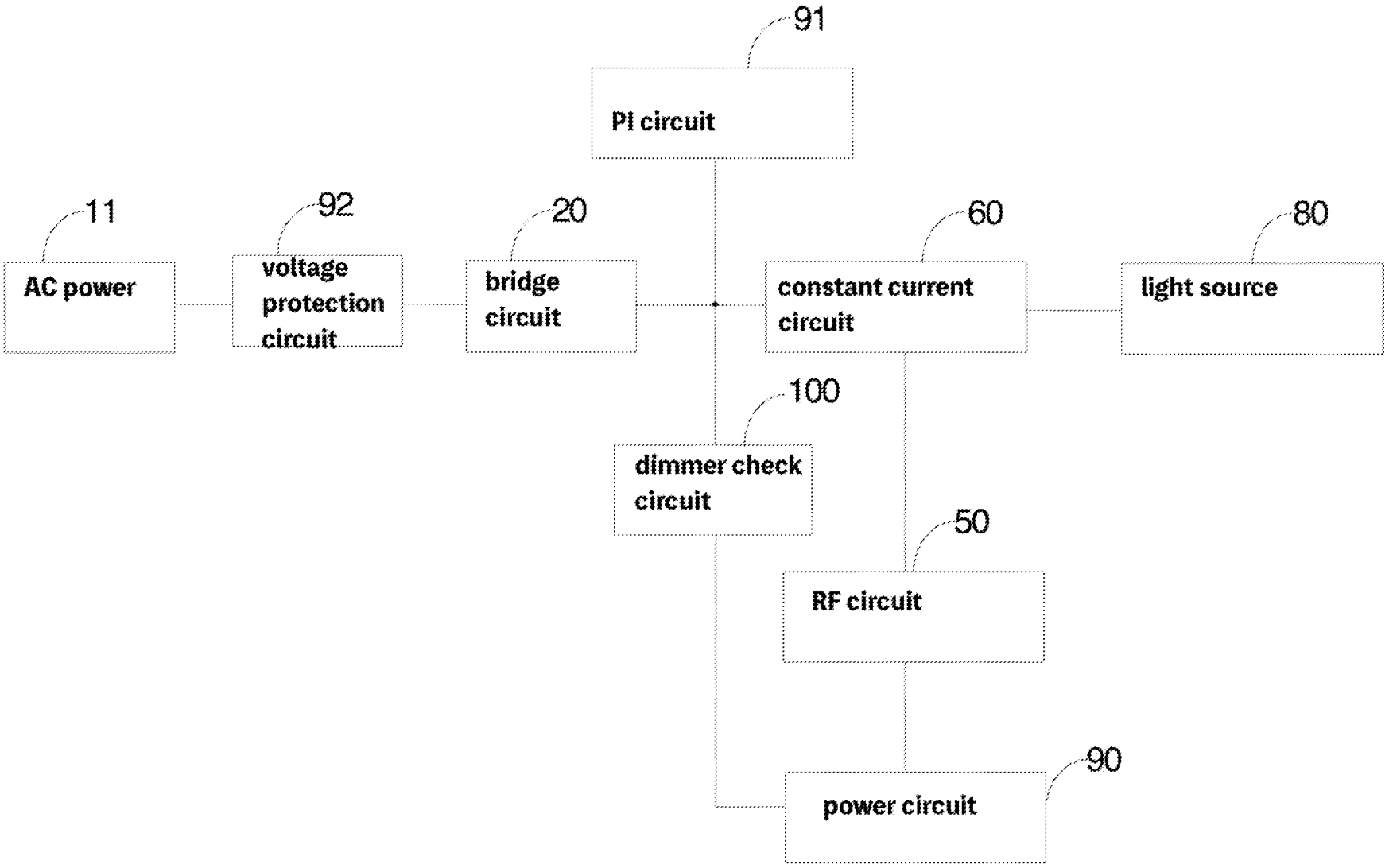
FIG. 4 illustrates another circuit diagram of a driver circuit in another embodiment.

FIG. 4 shows another embodiment. In addition to the components mentioned in FIG. 3, a PI circuit 91 is used for filtering output current of the bridge circuit 20.

Figure 5:
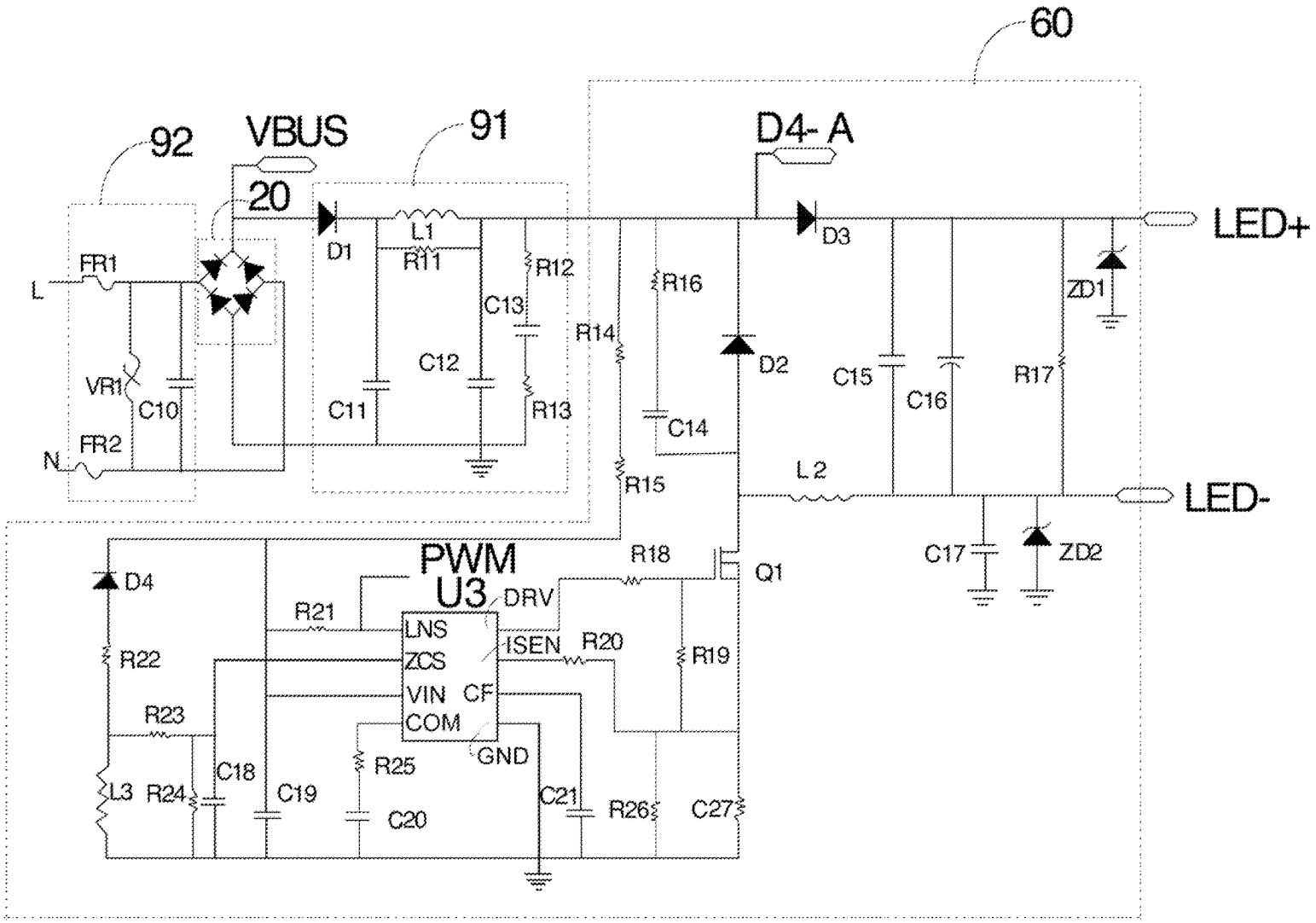
FIG. 5 illustrates a detailed circuit diagram of a driver circuit in another embodiment.

FIG. 5 shows another circuit example.

In FIG. 5, a power protection circuit 92 prevents sudden peak of voltage input. The bridge circuit 20 converts an AC power to a DC power. A PI filter 90 is used for filtering the DC power. A constant current circuit 60 is used for generating a constant current. A chip U3 is used for generating corresponding PWM signals for adjusting driving currents to mix a required light parameter.

Figure 6:
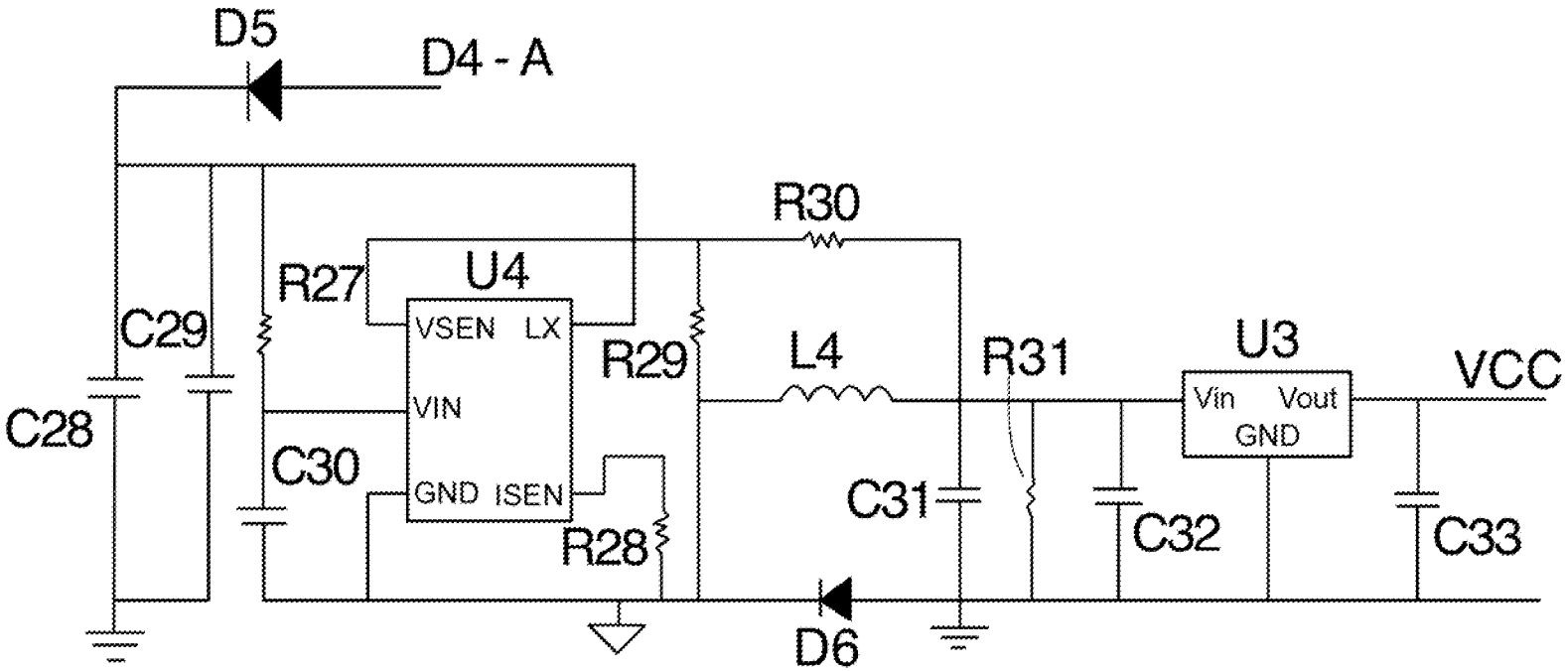
FIG. 6 illustrates another detailed circuit example.

FIG. 6 shows another part of the example in FIG. 5.

Figure 7:
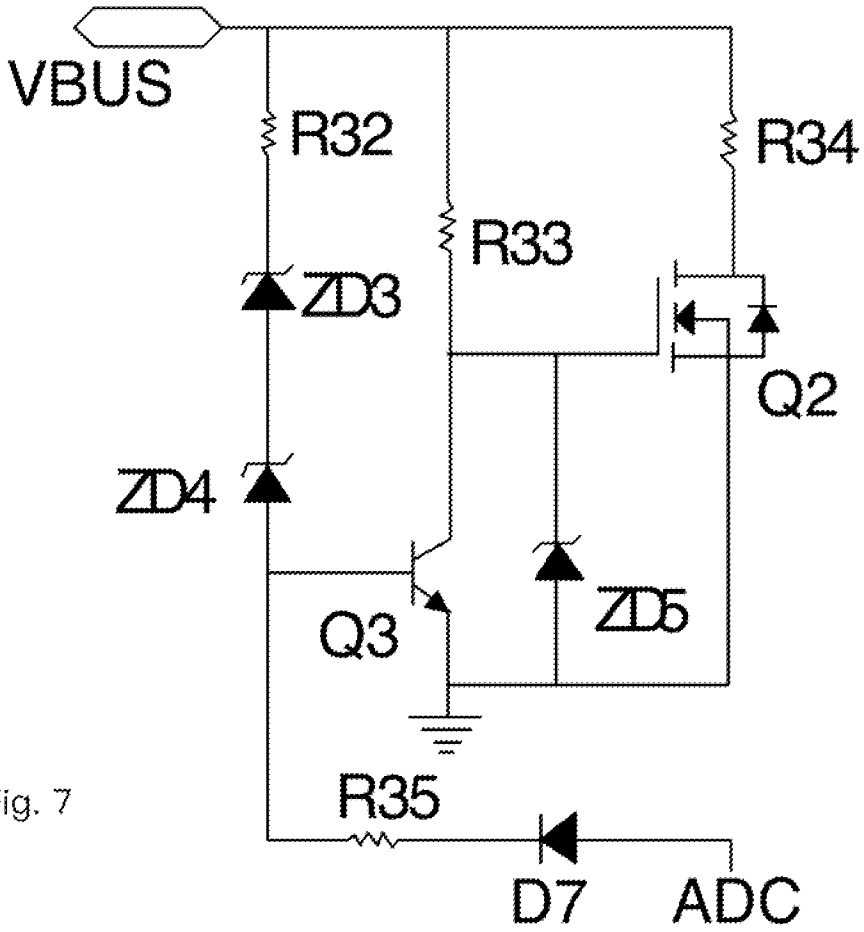
FIG. 7 illustrates a dimmer check circuit example.

FIG. 7 shows a voltage divider circuit example for detecting a voltage drop when a wall dimmer is attached to the lighting apparatus.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a light source comprising a LED module;

a bridge circuit for generating a DC power at a voltage node by converting an AC power;

a filter circuit connected to the voltage node for converting the DC power to a driving current to the LED module;

a dimmer check circuit coupled to the voltage node for generating a dimmer check signal by detecting whether a wall dimmer is electrically coupled to the lighting apparatus; and a control circuit for adjusting a setting of the filter circuit according to the dimmer check signal.

2. The lighting apparatus of claim 1, wherein the wall dimmer is a TRIAC dimmer.

3. The lighting apparatus of claim 2, wherein the DC power is a sine wave DC power.

4. The lighting apparatus of claim 2, wherein the filter circuit comprises a constant current circuit for generating the driving current.

5. The lighting apparatus of claim 4, wherein the filter circuit comprises a PI filter.

6. The lighting apparatus of claim 2, wherein the dimmer check circuit detects a voltage drop at the voltage node, wherein when the voltage drop over a first threshold is detected, the dimmer check signal indicates the wall dimmer is existed.

7. The lighting apparatus of claim 6, wherein the dimmer check circuit comprises multiple resistors and a capacitor, wherein the multiple resistors are used for dividing a Vbus voltage at the voltage node, and the capacitor is used for filter the sine wave DC power.

8. The lighting apparatus of claim 2, wherein the dimmer check circuit detects a voltage cut angle at the voltage node, wherein when the voltage cut angle is detected, the dimmer check signal indicates the wall dimmer is existed.

9. The lighting apparatus of claim 8, wherein the dimmer check circuit has a integral circuit for accumlating a voltage variation to detect the voltage cut angle.

10. The lighting apparatus of claim 2, wherein the dimmer check circuit detects a phase cut angle at the voltage node, wherein when the phase cut angle is detected, the dimmer check signal indicates the wall dimmer is existed.

11. The lighting apparatus of claim 2, wherein the dimmer check circuit comprises a comparator for retrieving a Vcc voltage of the filter circuit, wherein the comparator compares the Vcc voltage with a Vbus voltage at the voltage node to detect whether the wall dimmer is existed.

12. The lighting apparatus of claim 2, wherein the control circuit increases a support current when the wall dimmer is detected.

13. The lighting apparatus of claim 2, wherein the control circuit transmits a command to indicate an external the existance of the wall dimmer.

14. The lighting apparatus of claim 2, wherein the control circuit transmit the dimmer check signal to another lighting apparatus via a wireless channel, wherein said another lighting apparatus is also electrically connected to AC power.

15. The lighting apparatus of claim 2, wherein a TRIAC setting is detected by the dimmer check circuit, wherein the control circuit converts the TRIAC setting to a PWM signal supplied to the filter circuit to change the driving current to the LED module.

16. The lighting apparatus of claim 2, further comprising a manual switch, wherein when the manual switch is turned on, the dimmer check circuit is disabled.

17. The lighting apparatus of claim 2, wherein the control circuit detects a TRIAC vlaue variation of the wall dimmer within a time period to switch among multiple working modes of the filter circuit.

18. The lighting apparatus of claim 17, wherein the LED module has multiple types of LED units with different light parameters, wherein in a first working mode, a TRIAC setting of the wall dimmer is used for adjusting a first type of LED units.

19. The lighting apparatus of claim 17, wherein the LED module has multiple types of LED units with different light parameters, wherein in a second working mode, a TRIAC setting of the wall dimmer is used for adjusting a first type of LED units.

20. The lighting apparatus of claim 17, wherein the LED module has multiple types of LED units with different light parameters, wherein in a third working mode, a TRIAC setting is used for adjusting a color temperature of the LED module.

* * * * *